US011391501B2

(12) United States Patent
Junge et al.

(10) Patent No.: US 11,391,501 B2
(45) Date of Patent: Jul. 19, 2022

(54) MODULATOR FOR AN ICE MAKER

(71) Applicant: Haier US Appliance Solutions, Inc., Wilmington, DE (US)

(72) Inventors: Brent Alden Junge, Evansville, IN (US); Justin Tyler Brown, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 213 days.

(21) Appl. No.: 16/513,936

(22) Filed: Jul. 17, 2019

(65) Prior Publication Data

US 2021/0018237 A1 Jan. 21, 2021

(51) Int. Cl.

| | |
|---|---|
| ***F25C 1/12*** | (2006.01) |
| ***F25C 1/045*** | (2018.01) |
| ***F25D 11/02*** | (2006.01) |
| ***F25C 1/10*** | (2006.01) |
| ***F25C 5/182*** | (2018.01) |

(52) U.S. Cl.

CPC ..... *F25C 1/12* (2013.01); *F25C 1/045* (2013.01); *F25C 1/10* (2013.01); *F25C 5/182* (2013.01); *F25D 11/02* (2013.01); *F25C 2400/14* (2013.01); *F25D 2317/00* (2013.01); *F25D 2400/30* (2013.01)

(58) Field of Classification Search

CPC ..... F25C 1/12; F25C 1/045; F25C 2400/14; F25B 2345/001; F25B 2345/002; F25B 2600/05; F25D 2317/00; F25D 2400/30

See application file for complete search history.

(56) References Cited

U.S. PATENT DOCUMENTS

| | | | | |
|---|---|---|---|---|
| 4,359,874 | A | 11/1982 | McCarty | |
| 5,117,645 | A * | 6/1992 | Bryant | F25B 45/00 62/174 |
| 5,224,358 | A * | 7/1993 | Yamanaka | F25B 39/04 62/509 |
| 5,737,930 | A * | 4/1998 | Karl | B60H 1/00007 62/117 |
| 10,527,330 | B2 * | 1/2020 | Sekiya | F24F 11/65 |
| 10,801,768 | B2 * | 10/2020 | Junge | F25C 1/12 |

(Continued)

FOREIGN PATENT DOCUMENTS

| | | | |
|---|---|---|---|
| JP | 2004225924 | A | 8/2004 |

*Primary Examiner* — Cassey D Bauer

(74) *Attorney, Agent, or Firm* — Dority & Manning, P.A.

(57) ABSTRACT

An icemaker appliance includes a cabinet. A refrigeration system includes a compressor, a condenser, an expansion device, and an evaporator. The refrigeration system is charged with a refrigerant. The refrigeration system further includes a modulator having a reservoir and a supply conduit. The reservoir of the modulator is positioned on an outlet conduit of the evaporator. A first end portion of the supply conduit is coupled to an inlet conduit of the evaporator, and a second end portion of the supply conduit is coupled to the reservoir of the modulator. The refrigerant is flowable into and out of the reservoir of the modulator through the supply conduit of the modulator. An ice maker is positioned within the cabinet. The evaporator of the refrigeration system is coupled to the icemaker such that the refrigeration system is operable to chill the icemaker.

16 Claims, 4 Drawing Sheets

(56) References Cited

U.S. PATENT DOCUMENTS

| | | | | |
|---|---|---|---|---|
| 2015/0354873 | A1* | 12/2015 | Hartfield | F25B 39/00 62/119 |
| 2016/0146488 | A1* | 5/2016 | Ochiai | F25B 13/00 62/125 |
| 2018/0010833 | A1* | 1/2018 | Sibik | F25D 1/00 |
| 2020/0400363 | A1* | 12/2020 | Junge | F25D 17/02 |

* cited by examiner

MODULATOR FOR AN ICE MAKER

FIELD OF THE INVENTION

The present subject matter relates generally to ice makers for appliances.

BACKGROUND OF THE INVENTION

Certain consumers find clear ice preferable to cloudy ice. In clear ice formation processes, dissolved solids typically found within water, e.g., tap water, are separated out and essentially pure water freezes to form the clear ice. Since the water in clear ice is purer than that found in typical cloudy ice, clear ice is less likely to affect drink flavors. Clear ice is popular for serving with high end drinks due to its aesthetic appearance and reduced impurities. At certain high end bars, a popular clear ice offering is a single large clear ice sphere.

A longstanding customer desire is an ice maker that can produce clear ice, in particular single large clear ice spheres, economically.

BRIEF DESCRIPTION OF THE INVENTION

Aspects and advantages of the invention will be set forth in part in the following description, or may be apparent from the description, or may be learned through practice of the invention.

In a first example embodiment, an icemaker appliance includes a cabinet. A refrigeration system includes a compressor, a condenser, an expansion device, and an evaporator. The refrigeration system is charged with a refrigerant. The refrigeration system further includes a modulator having a reservoir and a supply conduit. The reservoir of the modulator is positioned on an outlet conduit of the evaporator. A first end portion of the supply conduit is coupled to an inlet conduit of the evaporator, and a second end portion of the supply conduit is coupled to the reservoir of the modulator. The refrigerant is flowable into and out of the reservoir of the modulator through the supply conduit of the modulator. An ice maker is positioned within the cabinet. The evaporator of the refrigeration system is coupled to the icemaker such that the refrigeration system is operable to chill the icemaker.

In a second example embodiment, an icemaker appliance includes a cabinet. A refrigeration system includes a compressor, a condenser, an expansion device, and an evaporator. The refrigeration system is charged with a refrigerant. The refrigeration system further includes a modulator having a reservoir and a supply conduit. The reservoir of the modulator is positioned on an outlet conduit of the evaporator. A first end portion of the supply conduit is coupled to an inlet conduit of the evaporator, and a second end portion of the supply conduit is coupled to the reservoir of the modulator. The refrigerant is flowable into and from the reservoir of the modulator through the supply conduit of the modulator. The refrigerant within the reservoir of the modulator is in thermal communication with the refrigerant within the outlet conduit of the evaporator. The modulator is configured for varying a volume of the refrigerant that flows through the refrigeration system in response to the temperature of the refrigerant within the outlet conduit of the evaporator. An ice maker is positioned within the cabinet. The evaporator of the refrigeration system is coupled to the ice maker such that the refrigeration system is operable to chill the ice maker.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
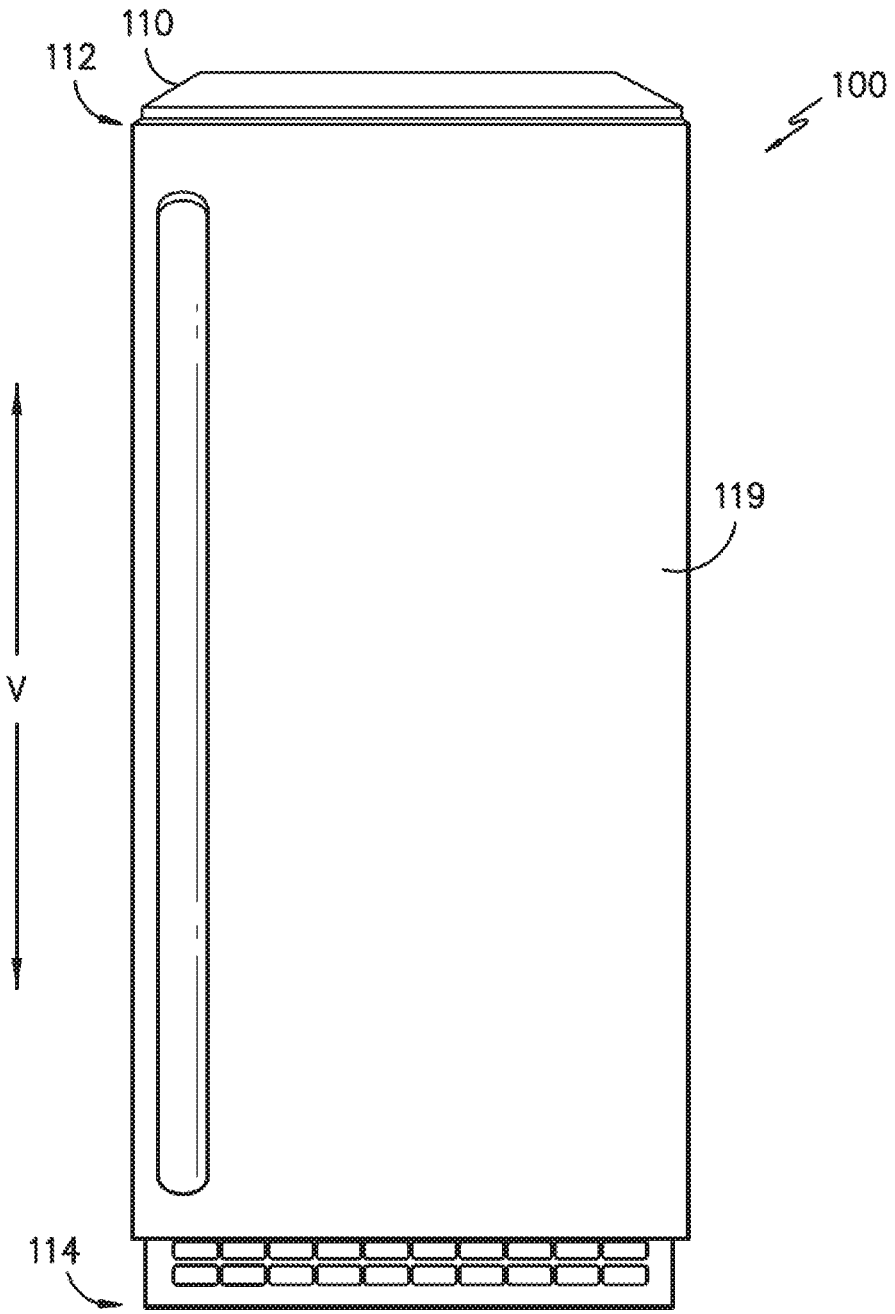
FIG. 1 is a front, perspective view of an icemaker appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
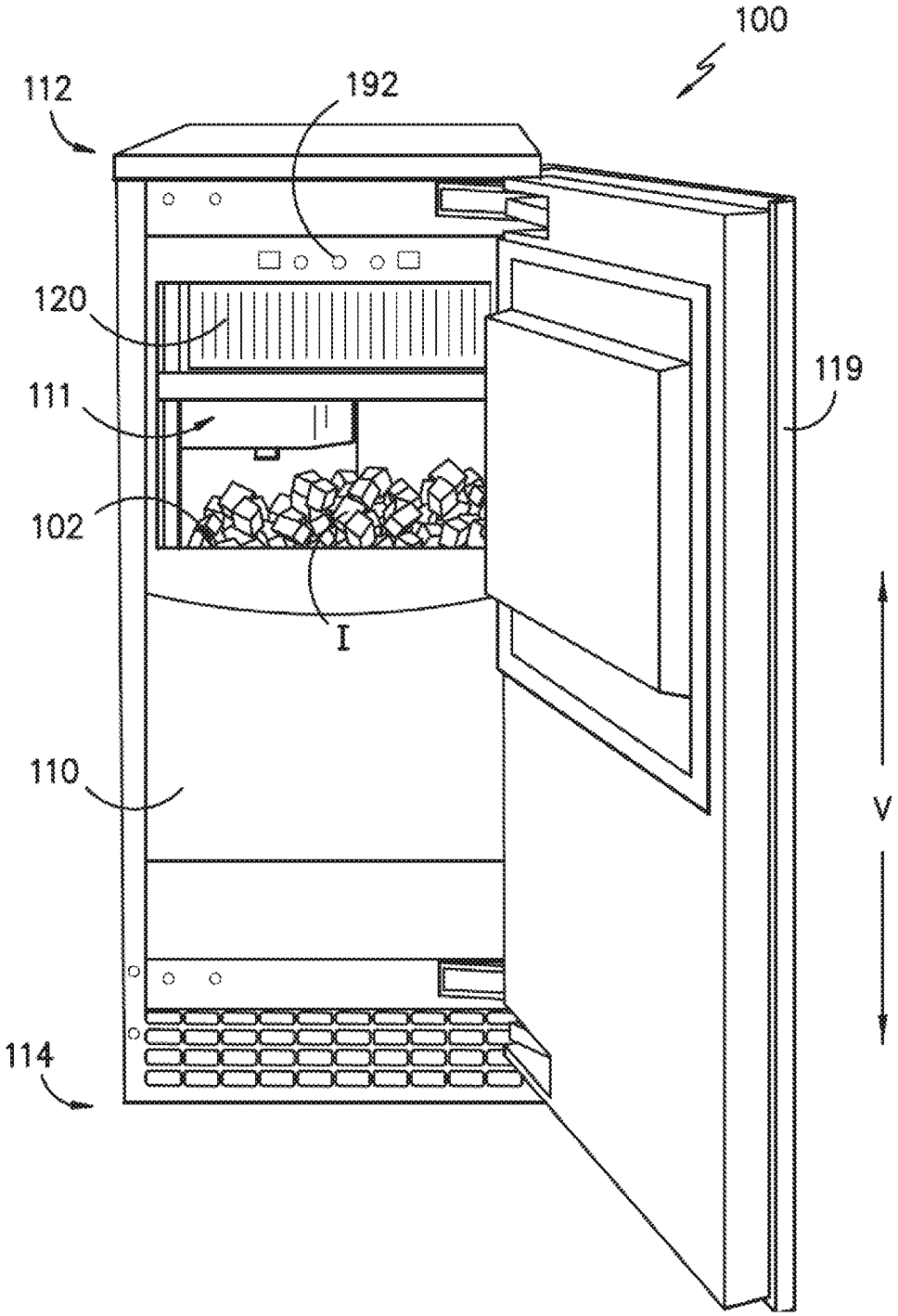
FIG. 2 is a front, perspective view of the example icemaker appliance of FIG. 1 with a door of the example icemaker appliance shown in an open position.

FIGS. 1 and 2 provide front, perspective views of an icemaker appliance 100 according to an example embodiment of the present subject matter. As discussed in greater detail below, icemaker appliance 100 includes features for generating or producing clear ice, such as clear ice billets. Thus, a user of icemaker appliance 100 may consume clear ice produced within icemaker appliance 100. As may be seen in FIG. 1, icemaker appliance 100 defines a vertical direction V.

Icemaker appliance 100 includes a cabinet 110. Cabinet 110 may be insulated in order to limit heat transfer between an interior volume 111 (FIG. 2) of cabinet 110 and ambient atmosphere. Cabinet 110 extends between a top portion 112 and a bottom portion 114, e.g., along the vertical direction V. Thus, top and bottom portions 112, 114 of cabinet 110 are spaced apart from each other, e.g., along the vertical direction V. A door 119 is mounted to cabinet 110 at a front portion of cabinet 110. Door 119 permits selective access to interior volume 111 of cabinet 110. For example, door 119 is shown in a closed position in FIG. 1, and door 119 is shown in an open position in FIG. 2. A user may rotate door between the open and closed positions to access interior volume 111 of cabinet 110.

As may be seen in FIG. 2, various components of icemaker appliance 100 are positioned within interior volume 111 of cabinet 110. In particular, icemaker appliance 100 includes an ice maker 120 disposed within interior volume 111 of cabinet 110, e.g., at top portion 112 of cabinet 110. Ice maker 120 is configured for producing clear ice I. Ice maker 120 may be configured for making any suitable type of clear ice. For example, ice maker 120 may be a billet-style ice maker, and the billet clear ice from ice maker 120 may be shaped into large clear ice spheres.

Icemaker appliance 100 also includes an ice storage compartment or storage bin 102. Storage bin 102 is disposed within interior volume 111 of cabinet 110. In particular, storage bin 102 may be positioned, e.g., directly, below ice maker 120 along the vertical direction V. Thus, storage bin 102 is positioned for receiving clear ice I from ice maker 120 and is configured for storing the clear ice I therein. It will be understood that storage bin 102 may be maintained at a temperature less than the freezing point of water. In alternative example embodiments, storage bin 102 may be maintained at a temperature greater than the freezing point of water. Thus, the clear ice I within storage bin 102 can melt over time while stored within storage bin 102. A control panel 192 on cabinet 110 allows a user to regulate operation of icemaker appliance 100.

Figure 3:
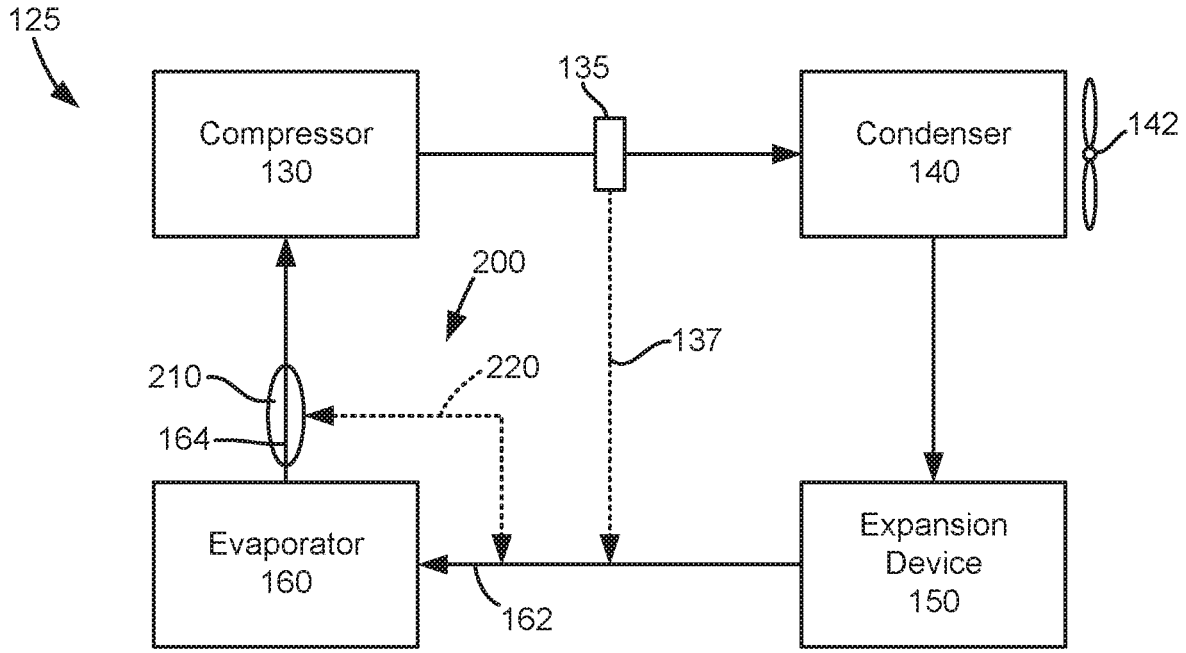
FIG. 3 is a schematic view of certain components of the example icemaker appliance of FIG. 1.

FIG. 3 is a schematic view of certain components of icemaker appliance 100. As may be seen in FIG. 3, icemaker appliance 100 includes a refrigeration system 125 with components for executing a known vapor compression cycle for chilling water within ice maker 120 to form the clear ice I. The components of refrigeration system 125 include a compressor 130, a condenser 140, an expansion device 150, and an evaporator 160 connected in series and charged with a refrigerant. As will be understood by those skilled in the art, refrigeration system 125 may include additional components, e.g., at least one additional evaporator, compressor, expansion device, and/or condenser. As an example, refrigeration system 125 may include two evaporators.

Within refrigeration system 125, refrigerant flows into compressor 130, which operates to increase the pressure of the refrigerant. This compression of the refrigerant raises a temperature of the refrigerant, which is lowered by passing the refrigerant through condenser 140. Within condenser 140, heat exchange with ambient air takes place so as to cool the refrigerant. A fan 142 is used to pull air across condenser 140 so as to provide forced convection for a more rapid and efficient heat exchange between the refrigerant within condenser 140 and the ambient air. Thus, as will be understood by those skilled in the art, increasing air flow across condenser 140 can, e.g., increase the efficiency of condenser 140 by improving cooling of the refrigerant contained therein.

An expansion device (e.g., a valve, capillary tube, or other restriction device) 150 receives refrigerant from condenser 140. From expansion device 150, the refrigerant enters evaporator 160. Upon exiting expansion device 150 and entering evaporator 160, the refrigerant drops in pressure. Due to the pressure drop and/or phase change of the refrigerant, evaporator 160 is cool relative to ice maker 120, e.g., water within ice maker 120. As such, water within ice maker 120 may freeze to form the clear ice I. Thus, evaporator 160 is a type of heat exchanger which transfers heat from water within ice maker 120 to refrigerant flowing through evaporator 160.

Refrigeration system 125 may also include a bypass valve 135 and a bypass conduit 137. Bypass valve 135 may be a servo motor driven bypass valve that is operable to directing hot gaseous refrigerant from compressor 130 to evaporator 160 through bypass conduit 137. Thus, bypass valve 135 may direct all or a portion of the gaseous refrigerant flowing between compressor 130 and condenser 150 into bypass conduit 137. By flowing through bypass valve 135, the refrigerant within bypass valve 135 does not flow through and bypasses condenser 140 and/or expansion device 150.

Bypass valve 135 and bypass conduit 137 may provide a mechanism for implementing a hot gas bypass for ice harvest at evaporator 160. As discussed in greater detail below, evaporator 160 may be coupled to ice maker 120 (FIG. 2) and refrigerant flowing through evaporator 160 may transfer heat with water in ice maker 120. When bypass valve 135 directs all or a portion of the gaseous refrigerant flowing between compressor 130 and condenser 150 into bypass conduit 137, the hot refrigerant flowing into evaporator 160 from bypass conduit 137 may partially melt ice within ice maker 120 to assist with harvesting the ice from ice maker 120.

Collectively, the vapor compression cycle components in a refrigeration circuit, associated fans, and associated compartments are sometimes referred to as a sealed refrigeration system operable to freeze water within ice maker 120. The refrigeration system 125 depicted in FIG. 3 is provided by way of example only. Thus, it is within the scope of the present subject matter for other configurations of the refrigeration system to be used as well.

Refrigeration system 125 also includes a modulator 200. Modulator 200 is configured for adjusting the charge of refrigerant flowing within refrigeration system 125, as discussed in greater detail below. As shown in FIG. 3, modulator 200 includes a reservoir 210 and a supply conduit 220. Reservoir 210 is positioned on an outlet conduit 164 of evaporator 160. The outlet conduit 164 of evaporator 160 may extend from evaporator 160, and refrigerant exiting evaporator 160 may flow through outlet conduit 164 towards compressor 130. In contrast, an inlet conduit 162 of evaporator 160 may extend to evaporator 160, and refrigerant flowing from expansion device 150 may flow through outlet conduit 164 into evaporator 160.

Supply conduit 220 extends between and connects reservoir 210 and inlet conduit 162 of evaporator 160. Thus, refrigerant at inlet conduit 162 of evaporator 160 may flow into reservoir 210 via supply conduit 220. In addition, refrigerant within reservoir 210 may flow into inlet conduit 162 of evaporator 160 via supply conduit 220. Thus, refrigerant is flowable into and from reservoir 210 through supply conduit 220. As discussed in greater detail below, modulator 200 may draw refrigerant from inlet conduit 162 into reservoir 210 via supply conduit 220 or may supply refrigerant from reservoir 210 into inlet conduit 162 via supply conduit 220, e.g., based on the temperature of refrigerant within outlet conduit 164 of evaporator 160.

Figure 4:
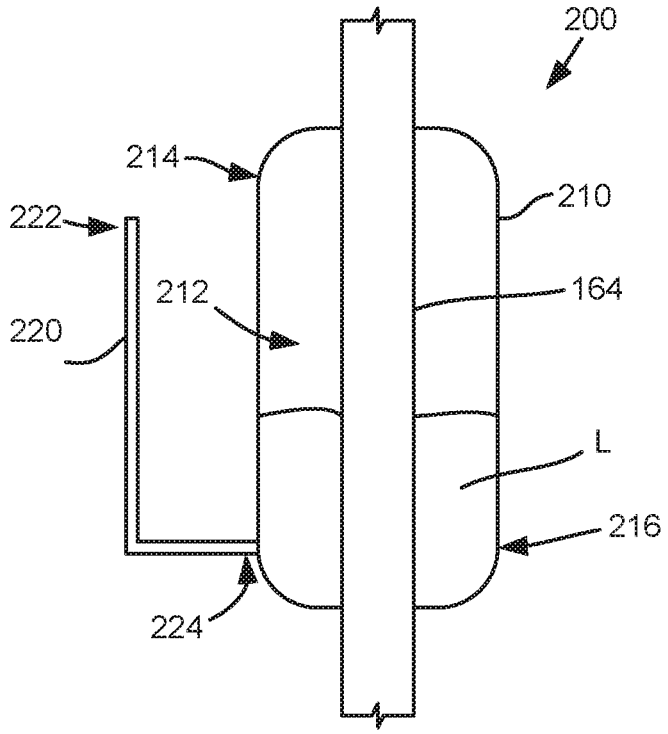
FIG. 4 is a schematic view of a modulator of the example icemaker appliance of FIG. 1.

FIG. 4 is a schematic view of modulator 210. As shown in FIG. 4, supply conduit 220 may extend between a first end portion 222 and a second end portion 224. First end portion 222 of supply conduit 220 may be coupled to inlet conduit 162 (FIG. 3). Thus, refrigerant from inlet conduit 162 may enter supply conduit 220 at first end portion 222 of supply conduit 220. Similarly, refrigerant from reservoir 210 may exit supply conduit 220 and enter inlet conduit 162 at first end portion 222 of supply conduit 220. Second end portion 224 of supply conduit 220 may be coupled to reservoir 210. Thus, refrigerant from reservoir 210 may enter supply conduit 220 at second end portion 224 of supply conduit 220. Similarly, refrigerant from inlet conduit 162 may exit supply conduit 220 and enter reservoir 210 at second end portion 224 of supply conduit 220. Reservoir 210 may extend between a top portion 214 and a bottom portion 216, and second end portion 224 of supply conduit 220 may be positioned at bottom portion 216 of reservoir 210. Thus, e.g., refrigerant may enter and exit supply conduit 220 at bottom portion 216 of reservoir 210.

As noted above, reservoir 210 is positioned on outlet conduit 164. In particular, reservoir 210 may be positioned on outlet conduit 164 such that outlet conduit 164 is positioned concentrically with an interior volume 212 of reservoir 210. Thus, e.g., refrigerant within interior volume 212 of reservoir 210 may contact outlet conduit 164. To mount reservoir 210 on outlet conduit 154, reservoir 210 may be soldered to outlet conduit 154. For example, top and bottom portions 214, 216 of reservoir 210 may be soldered to outlet conduit 154. In alternative example embodiments, outlet conduit 154 may be positioned on an exterior surface of reservoir 210, e.g., such that outlet conduit 154 is positioned outside of interior volume 212 of reservoir 210. In particular, outlet conduit 154 may be soldered to the exterior surface of reservoir 210. In such example embodiments, heat transfer between refrigerant within reservoir 210 and refrigerant within outlet conduit 154 may be limited compared to the example arrangement shown in FIG. 4.

Supply conduit 220 provides a flow path for refrigerant in refrigeration system 125 to flow into and out of reservoir 210. In particular, modulator 200 may form a dead end branch for refrigerant within refrigeration system 125. Thus, interior volume 212 of reservoir 210 may not be in direct fluid communication with the interior of outlet conduit 164, and, while refrigerant (labeled L in FIG. 4) within interior volume 212 of reservoir 210 can contact an exterior of outlet conduit 164, the refrigerant L within interior volume 212 of reservoir 210 cannot flow directly into outlet conduit 164, e.g., without exiting reservoir 210 via supply conduit 220. While not able to bypass evaporator 160 via modulator 200, the refrigerant L within interior volume 212 may exchange heat with refrigerant within outlet conduit 164, as discussed in greater detail below.

Interior volume 212 of reservoir 210 may be sized to contain a suitable volume of refrigerant. For example, interior volume 212 of reservoir 210 may be sized to contain no less than five cubic centimeters (5 $cm^3$) of refrigerant and no more than a half of a liter (0.5 L) of refrigerant. As noted above, modulator 200 may draw refrigerant from inlet conduit 162 into reservoir 210 via supply conduit 220 or may supply refrigerant from reservoir 210 into inlet conduit 162 via supply conduit 220. The above recited sizing of reservoir 210 may advantageously allow a desirable volume of refrigerant to be stored within reservoir 210, e.g., and thus not be cycled through refrigeration system 125. By sizing interior volume 212 of reservoir 210 to store a suitable volume of refrigerant, the above recited sizing of reservoir 210 may advantageously allow modulator 200 to vary the volume of refrigerant flowing through refrigeration system 125.

Figure 5:
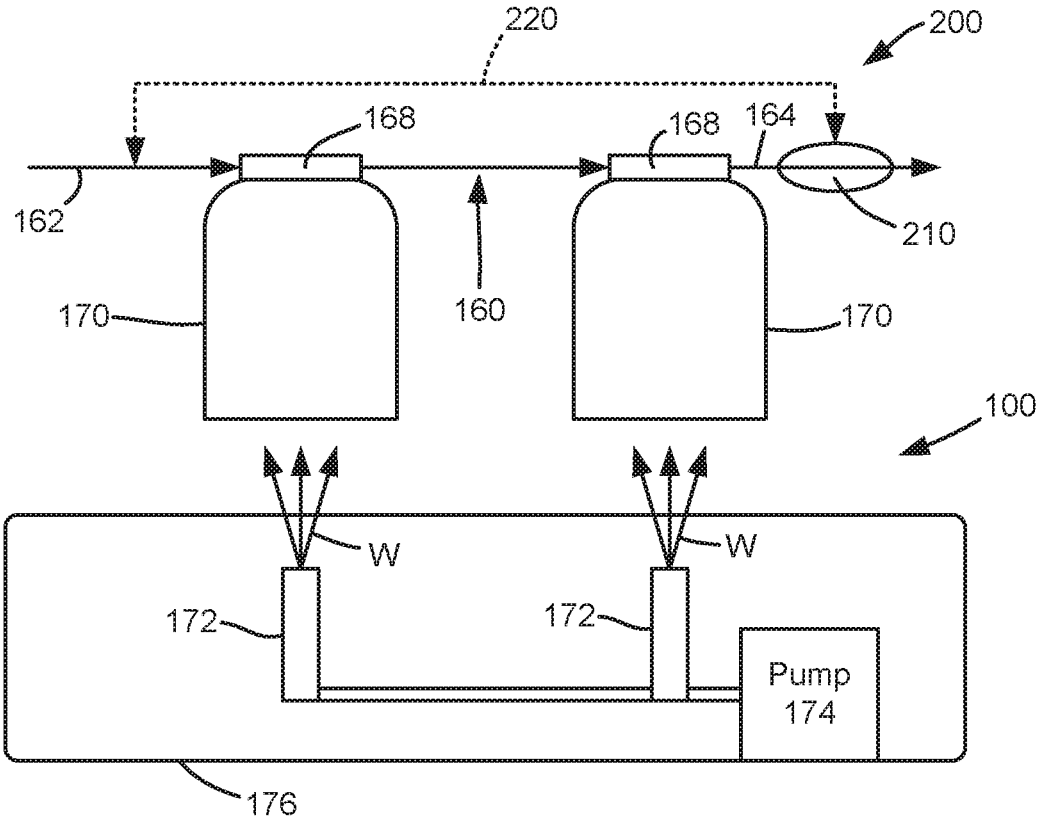
FIG. 5 is a schematic view of an ice maker of the example appliance of FIG. 1.

FIG. 5 is a schematic view of ice maker 120 of icemaker appliance 100. Refrigeration system 125 may be operable to chill ice maker 120, in particular water within ice maker 120, to form the clear ice I within ice maker 120. Thus, as may be seen in FIG. 5, evaporator 160 may be coupled to ice maker 120. In particular, ice maker 120 may be a billet ice maker with a plurality of mold bodies 170, a plurality of spray nozzles 172, and a pump 174.

Evaporator 160 may include a plurality of coils 168, and each coil 168 may be positioned at a top portion of a respective mold body 170. Each spray nozzle 172 is positioned and oriented towards a respective mold body 172. Pump 174 is operable to flow water W from a reservoir 176 through nozzles 172 towards mold bodies 170. As pump 174 flows water W into mold bodies 170, refrigerant flowing through coils 168 freezes the water W to form clear ice billets within molds 170.

Mold bodies 170 may be sized to form suitable clear ice billets. For example, each mold body 170 may be sized for forming an ice billet having a width of about three inches (3"). The above recite sizing of mold bodies 170 may advantageously provide a large ice billet, e.g., suitable for formation into a spherical clear ice cube. In alternative example embodiments, each mold body 170 may be sized for forming an ice billet having a width of about one inch (1") or about two inches (2"). As used herein, the term "about" means within half an inch (0.5") of the stated width when used in the context of widths.

Operation of modulator 210 to regulate the volume of refrigerant flowing through refrigeration system 125 will now be described in greater detail below. When icemaker appliance 100 begins an ice formation cycle to form clear ice I with ice maker 120, room temperature water may be sprayed into mold bodies 170 through nozzles 172. Evaporator 160 is in thermal communication with mold bodies 170, and an evaporation temperature of the refrigerant within evaporator 160 may be about forty degrees Fahrenheit (40° F.) at the start of the ice formation cycle when the room temperature water is sprayed into mold bodies 170. As used herein the term "about" means within five degrees of the stated temperature when used in the context of temperatures. As the water is chilled and ice begins to form within mold bodies 170, the evaporator temperature drops to below freezing, i.e., thirty-two degrees Fahrenheit (32° F.). By the time, ice formation cycle is complete and a large, e.g., three inch, billet is formed within mold bodies 170, the evaporator temperature may be as cold as negative twenty degrees Fahrenheit (−20° F.).

Because the temperature of the refrigerant within evaporator 160 can vary dramatically between the beginning and the end of the ice formation cycle, the optimum charge of refrigerant to fully flood evaporator 160 constantly changes. As the evaporator temperature and pressure drops, so does the amount of refrigerant required to fully flood evaporator 160. Modulator 200 is configured to regulate the charge of refrigerant flowing through refrigeration system 125, e.g., and provide an optimum charge in evaporator 160 throughout the ice making cycle.

When evaporator 160 is fully flooded, the temperature of refrigerant within outlet conduit 164, i.e., the evaporator outlet temperature, is less than the temperature of refrigerant within inlet conduit 162, i.e., the evaporator inlet temperature, due to the pressure drop of refrigerant within evaporator 160. Such temperature differential between the evaporator outlet and inlet temperatures causes refrigerant within inlet conduit 162 to migrate towards interior volume 212 of reservoir 210 via supply conduit 220. Within interior volume 212 of reservoir 210, the refrigerant from inlet conduit 162 condenses and is stored, e.g., until evaporator 160 is not fully flooded.

When evaporator 160 is not fully flooded and does not have optimum charge, the refrigerant within outlet conduit 164 may become superheated. Thus, the evaporator outlet temperature increases. The hotter refrigerant within outlet conduit 164 may transfer heat to the refrigerant L within interior volume 212 of reservoir 210 and thereby increase the vapor pressure of the refrigerant L within interior volume 212 of reservoir 210. When the vapor pressure of the refrigerant L is greater than the vapor pressure of refrigerant in inlet conduit 162, refrigerant L within reservoir 210 migrates towards inlet conduit 162 and back into refrigeration system 125 via supply conduit 220.

As may be seen from the above, modulator 200 moves refrigerant into and out of refrigeration system 125 based on the evaporator outlet temperature. Modulator 200 may advantageously be a passive system without moving parts. Thus, e.g., modulator 200 may regulate the charge of refrigeration system 125 based entirely on thermodynamics and vapor pressure, e.g., and without require sensors, control valves, etc. When evaporator 160 is low on charge, e.g., as can happen at the beginning of an ice making cycle when the temperature and pressure of refrigerant within evaporator is high, the evaporator outlet temperature increases due to refrigerant superheating. Such superheating drives refrigerant stored in modulator 200 back out into refrigeration system 125, e.g., into evaporator 160. Conversely, when the evaporator outlet temperature is low due to evaporator 160 being fully flooded, the evaporator outlet temperature is less than the evaporator inlet temperature due to the pressure drop through evaporator 160. Such temperature differential drives refrigerant to migrate from inlet conduit 162 into modulator 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker appliance, comprising:

a cabinet;

a refrigeration system comprising a compressor, a condenser, an expansion device, and an evaporator, the refrigeration system charged with a refrigerant, the refrigeration system further comprising a modulator having a reservoir and a supply conduit, the reservoir of the modulator positioned on an outlet conduit of the evaporator, a first end portion of the supply conduit coupled to an inlet conduit of the evaporator, a second end portion of the supply conduit coupled to the reservoir of the modulator, the refrigerant flowable into and out of the reservoir of the modulator through the supply conduit of the modulator; and an ice maker positioned within the cabinet, the evaporator of the refrigeration system coupled to the icemaker such that the refrigeration system is operable to chill the icemaker, wherein the ice maker is a billet ice maker comprising a plurality of mold bodies, a plurality of spray nozzles, and a pump, each of the plurality of spray nozzles oriented towards a respective one of the plurality of mold bodies, the pump operable to flow water through the plurality of nozzles towards the plurality of mold bodies, and wherein each of the plurality of mold bodies is sized for forming an ice billet having a width of about three inches.

2. The icemaker appliance of claim 1, wherein the evaporator comprises a plurality of coils, each coil of the plurality of coils positioned at a top portion of a respective one of the plurality of mold bodies.

3. The icemaker appliance of claim 1, wherein the outlet conduit of the evaporator extends through the reservoir of the modulator.

4. The icemaker appliance of claim 3, wherein the outlet conduit of the evaporator is positioned concentrically with an interior volume of the reservoir.

5. The icemaker appliance of claim 1, wherein the reservoir is soldered to the outlet conduit of the evaporator.

6. The icemaker appliance of claim 1, wherein an interior volume of the reservoir is sized to contain no less than a five cubic centimeters of the refrigerant and no more than five hundred cubic centimeters of the refrigerant.

7. The icemaker appliance of claim 1, wherein the modulator forms a dead end branch for the refrigerant.

8. The icemaker appliance of claim 7, wherein the modulator is configured for varying a volume of the refrigerant that flows through the refrigeration system.

9. The icemaker appliance of claim 1, wherein the refrigeration system further comprises a bypass valve and a bypass conduit, the bypass valve positioned downstream of the compressor and upstream of the condenser, the bypass valve operable to direct refrigerant flowing between the compressor and the condenser into the bypass conduit, an exit of the bypass conduit positioned upstream of the evaporator.

10. An icemaker appliance, comprising:

a cabinet;

a refrigeration system comprising a compressor, a condenser, an expansion device, and an evaporator, the refrigeration system charged with a refrigerant, the refrigeration system further comprising a modulator having a reservoir and a supply conduit, the reservoir of the modulator positioned on an outlet conduit of the evaporator, a first end portion of the supply conduit coupled to an inlet conduit of the evaporator, a second end portion of the supply conduit coupled to the reservoir of the modulator, the refrigerant flowable into and from the reservoir of the modulator through the supply conduit of the modulator, the refrigerant within the reservoir of the modulator in thermal communication with the refrigerant within the outlet conduit of the evaporator, the modulator configured for varying a volume of the refrigerant that flows through the refrigeration system in response to the temperature of the refrigerant within the outlet conduit of the evaporator; and an ice maker positioned within the cabinet, the evaporator of the refrigeration system coupled to the ice maker such that the refrigeration system is operable to chill the ice maker, wherein the ice maker is a billet ice maker comprising a plurality of mold bodies, a plurality of spray nozzles, and a pump, each of the plurality of spray nozzles oriented towards a respective one of the plurality of mold bodies, the pump operable to flow water through the plurality of nozzles towards the plurality of mold bodies, and wherein each of the plurality of mold bodies is sized for forming an ice billet having a width of about three inches.

11. The icemaker appliance of claim 10, wherein the evaporator comprises a plurality of coils, each coil of the plurality of coils positioned at a top portion of a respective one of the plurality of mold bodies.

12. The icemaker appliance of claim 10, wherein the outlet conduit of the evaporator extends through the reservoir of the modulator.

13. The icemaker appliance of claim 12, wherein the outlet conduit of the evaporator is positioned concentrically with an interior volume of the reservoir.

14. The icemaker appliance of claim 10, wherein the reservoir is soldered to the outlet conduit of the evaporator.

15. The icemaker appliance of claim 10, wherein an interior volume of the reservoir is sized to contain no less than five cubic centimeters of the refrigerant and no more than five hundred cubic centimeters of the refrigerant.

16. The icemaker appliance of claim 10, wherein the modulator forms a dead end branch for the refrigerant.

* * * * *